US006328628B1

(12) United States Patent
Mizuno et al.

(10) Patent No.: US 6,328,628 B1
(45) Date of Patent: Dec. 11, 2001

(54) EYEGLASS LENS LAYOUT DEVICE AND EYEGLASS LENS PROCESSING APPARATUS HAVING THE SAME

(75) Inventors: Toshiaki Mizuno; Masakazu Funakura, both of Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 09/365,891

(22) Filed: Aug. 3, 1999

(30) Foreign Application Priority Data

Aug. 3, 1998 (JP) ..... 10-219410

(51) Int. Cl.[7] ..... B24B 13/06
(52) U.S. Cl. ..... 451/5; 364/474.01; 451/43
(58) Field of Search ..... 451/5, 255, 256, 451/43; 364/474.01

(56) References Cited

U.S. PATENT DOCUMENTS

| | | | | |
|---|---|---|---|---|
| Re. 35,898 | | 9/1998 | Shibata et al. | 451/5 |
| 4,557,076 | * | 12/1985 | Helbrecht | 451/5 |
| 4,656,590 | * | 4/1987 | Ace | 451/256 |
| 5,138,770 | | 8/1992 | Matsuyama | 33/28 |
| 5,228,242 | | 7/1993 | Matsuyama | 51/165.74 |
| 5,333,412 | | 8/1994 | Matsuyama | 51/165.71 |
| 5,347,762 | | 9/1994 | Shibata et al. | 451/15 |

FOREIGN PATENT DOCUMENTS

| | | | |
|---|---|---|---|
| 576268 A1 | 12/1993 | (EP) | G06F/15/24 |
| 2-167523 | 6/1990 | (JP) | G02C/13/00 |
| 2-190245 | 7/1990 | (JP) | B24B/9/14 |
| 3-20603 | 1/1991 | (JP) | G01B/5/06 |

* cited by examiner

*Primary Examiner*—Robert A. Rose
(74) *Attorney, Agent, or Firm*—Sughrue, Mion, Zinn, Macpeak & Seas, PLLC

(57) ABSTRACT

The invention relates to an eyeglass lens layout device for performing layout to fit an eyeglass lens to an eyeglass frame, and an eyeglass lens processing apparatus with the eyeglass lens layout device incorporated therein. The device include a layout data input system by which layout data are inputted for each of horizontal and vertical layout items with respect to the frame, a memory in which layout methods are stored corresponding to lens types, a designating system by which one of the lens types can be designated; and a controller which retrieves one of the layout methods from the memory and sets the retrieved one of the layout methods for a corresponding one of the layout items, in accordance with the designated one of the lens types.

8 Claims, 6 Drawing Sheets

VERTICAL LAYOUT OF BIFOCAL LENS

VERTICAL LAYOUT OF MONOFOCAL LENS AND PROGRESSIVE LENS

EYEGLASS LENS LAYOUT DEVICE AND EYEGLASS LENS PROCESSING APPARATUS HAVING THE SAME

BACKGROUND OF THE INVENTION

The present invention relates to an eyeglass lens layout device for performing layout for fitting an eyeglass lens to an eyeglass frame, and an eyeglass lens processing apparatus having the eyeglass lens layout device.

The types of eyeglass lens include a monofocal lens, a multifocal lens such as a bifocal lens, and a progressive multifocal lens. Depending on the type of the eyeglass lens, a different type of layout must be carried out to fit the eyeglass lens to an eyeglass frame.

In the case of the monofocal lens, horizontal layout is performed on the basis of data on the distance between centers of eyeglass frame portions (FPD) and the wearer's pupillary distance (PD) data, and vertical layout is performed on the basis of information on the height of the optical center of the lens with respect to the frame center (geometric center) of the eyeglass frame (data on the distance between the frame center and the optical center).

In the case of the bifocal lens, in general, horizontal layout is performed on the basis of FPD data of the eyeglass frame and the wearer's PD data for near use, and vertical layout is performed on the basis of data on the distance from the center of a small-lens upper boundary line to a lowest portion of the lens.

On the other hand, in the case of the progressive multifocal lens, vertical layout is in many cases performed on the basis of data on the distance from the wearer's eyepoint for far use to the bottom of the lens directly therebelow.

It should be noted that, in the case of the bifocal lens, there are cases where vertical layout is performed on the basis of data on the distance from the center of a small-lens upper boundary line to the bottom of the lens directly therebelow. Also, in the case of the progressive multifocal lens as well, there are cases where vertical layout is performed on the basis the distance from the far-use eyepoint to the lowest portion of the lens.

A layout device in a background art requires data input for such various layout types or methods in the following manner: FIG. 8 is a diagram illustrating a display screen for layout and switches for input in an apparatus. If frame data of an eyeglass frame measured by an eyeglass-frame-shape measuring device is inputted to the layout device, a target lens configuration 810 based on the frame data is displayed on the screen of a display unit 800, and it becomes possible to input layout data by using switches of a switch section 850. In the case of a monofocal lens, to input the vertical layout, a cursor 811 is moved by operating a switch 857 to an item 803 where the vertical layout data are to be input, and then a prescription value of the height is inputted using a "−" switch 858*a* or a "+" switch 858*b*.

In the case of a bifocal lens, the cursor 811 is moved to an item 805 indicating a layout mode, and the mode is changed to a bifocal mode by operating a change switch 859. Subsequently, the cursor 811 is moved to an item 803, and after the method is changed to a "BT vertical" method for inputting the height from the center of a small-lens upper boundary line to a lowest portion of the lens by operating the change switch 859, a prescription value is inputted.

In the case of a progressive multifocal lens, after the display of the item 805 is changed to an optical center mode, the cursor 811 is moved to the item 803. After the method is changed to a "PD vertical" method for inputting the height from the wearer's eyepoint for far use to the bottom of the lens directly therefrom by operating the change switch 859, its prescription value is inputted.

Thus, in fitting the eyeglass lens to the eyeglass frame, a different layout method depending on each lens type must be used, and the operator must change the layout method on each occasion in conformity with the lens type, which is time-consuming and troublesome. In addition, this change is difficult to understand for a less-experienced operator, and the operation while referring to an operation manual is troublesome.

SUMMARY OF THE INVENTION

In view of the above-described problems, it is an object of the present invention to provide an apparatus which makes it possible to easily effect, without an error, a change of the layout method which differs for each lens type.

To attain the above object, the present invention is characterized by having the following configurations.

(1) An eyeglass lens layout device for performing layout to fit an eyeglass lens to an eyeglass frame, said device comprising:

layout data input means for inputting layout data for each of horizontal and vertical layout items with respect to the frame;

storing means for storing layout methods corresponding to lens types;

designating means for designating one of the lens types; and setting means for retrieving one of the layout methods from the storing means and setting the retrieved one of the layout methods for a corresponding one of the layout items, in accordance with the designated one of the lens types.

(2) An eyeglass lens layout device according to (1), wherein the lens types includes at least one of a monofocal lens, a bifocal lens and a progressive multifocal lens, and the layout methods to be set for the vertical layout item include at least one of a layout method by which layout is carried out based on a height of an optical center of the lens with respect to a geometric center of the frame, a layout method by which layout is carried out based on a distance from a certain point, which is determined in accordance with each of the lens types, to a point on a bottom of a target lens shape, which is located vertically below the certain point, and a layout method by which layout is carried out based on a height from a lowest point of a target lens shape to the certain point.

(3) An eyeglass lens layout device according to (2), wherein the certain point determined in accordance with each of the lens types is an optical center in case of the monofocal lens, a center of a small-lens upper boundary line in case of the bifocal lens and a wearer's eyepoint for far use in case of the progressive multifocal lens.

(4) An eyeglass lens layout device according to (1), further comprising:

changing means for changing a relationship between the lens types and the corresponding layout methods.

(5) An eyeglass lens layout device according to (4), wherein the changing means includes displaying means for displaying a screen on which the relationship is changed.

(6) An eyeglass lens layout device according to (1), further comprising:

frame data inputting means for inputting frame shape data of the eyeglass frame, and wherein the layout of the lens is carried out with respect to the inputted frame shape data.

(7) An eyeglass lens layout device according to (1), further comprising:

transmitting means for transmitting the layout data to an eyeglass lens processing apparatus for grinding an periphery of the lens.

(8) An eyeglass lens layout device according to (1), wherein the eyeglass lens layout device is installed in an eyeglass lens processing apparatus for grinding an periphery of the lens.

(9) An eyeglass lens processing apparatus for grinding an periphery of an eyeglass lens, said apparatus comprising:

lens holding means for holding and rotating the lens;

processing means, having at least one abrasive wheel, for processing the lens with the rotating abrasive wheel;

frame data input means for inputting frame shape data on an eyeglass frame;

layout data input means for inputting layout data for each of horizontal and vertical layout items with respect to the frame shape data thus inputted;

arithmetic means for obtaining processing data based on the frame shaped data and the layout data; and processing control means for controlling processing to the lens based on the processing data thus obtained;

wherein the layout data input means includes:

storing means for storing layout methods corresponding to lens types;

designating means for designating one of the lens types; and setting means for retrieving one of the layout methods from the storing means and setting the retrieved one of the layout methods for a corresponding one of the layout items, in accordance with the designated one of the lens types.

(10) An eyeglass lens processing apparatus according to (9), wherein the layout data input means further includes:

changing means for changing a relationship between the lens types and the corresponding layout methods.

(11) An eyeglass lens processing apparatus according to (10), wherein the changing means includes displaying means for displaying a screen on which the relationship is changed.

(12) An eyeglass lens processing apparatus according to (9), wherein the processing control means varies a distance between an axis about which the lens is rotated and an axis about which the abrasive wheel is rotated, to thereby control the processing to the lens.

(13) An eyeglass lens layout device comprising:

a display section;

an input section having a lens type designation switch;

a parameter memory in which a relationship between lens types and corresponding lens layout methods is stored; and a controller operatively connected to the display section, the input section and the parameter memory.

The present disclosure relates to the subject matter contained in Japanese patent application No. Hei. 10-219410 (filed on Aug. 3, 1998), which is expressly incorporated herein by reference in its entirety.

DESCRIPTION OF THE PREFERRED EMBODIMENT

Figure 1:
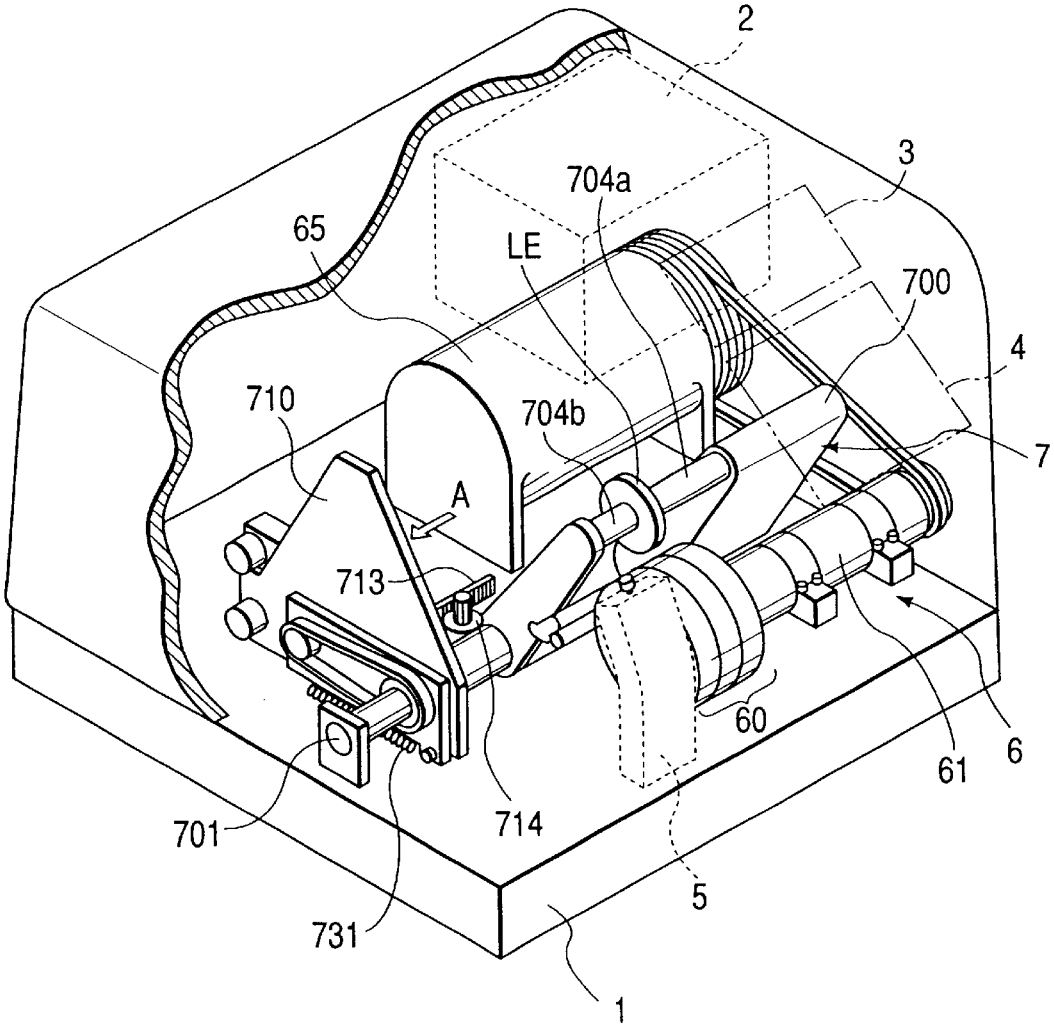
FIG. 1 a perspective view illustrating an overall configuration of an eyeglass lens processing apparatus in accordance with the present invention.
Figure 2:
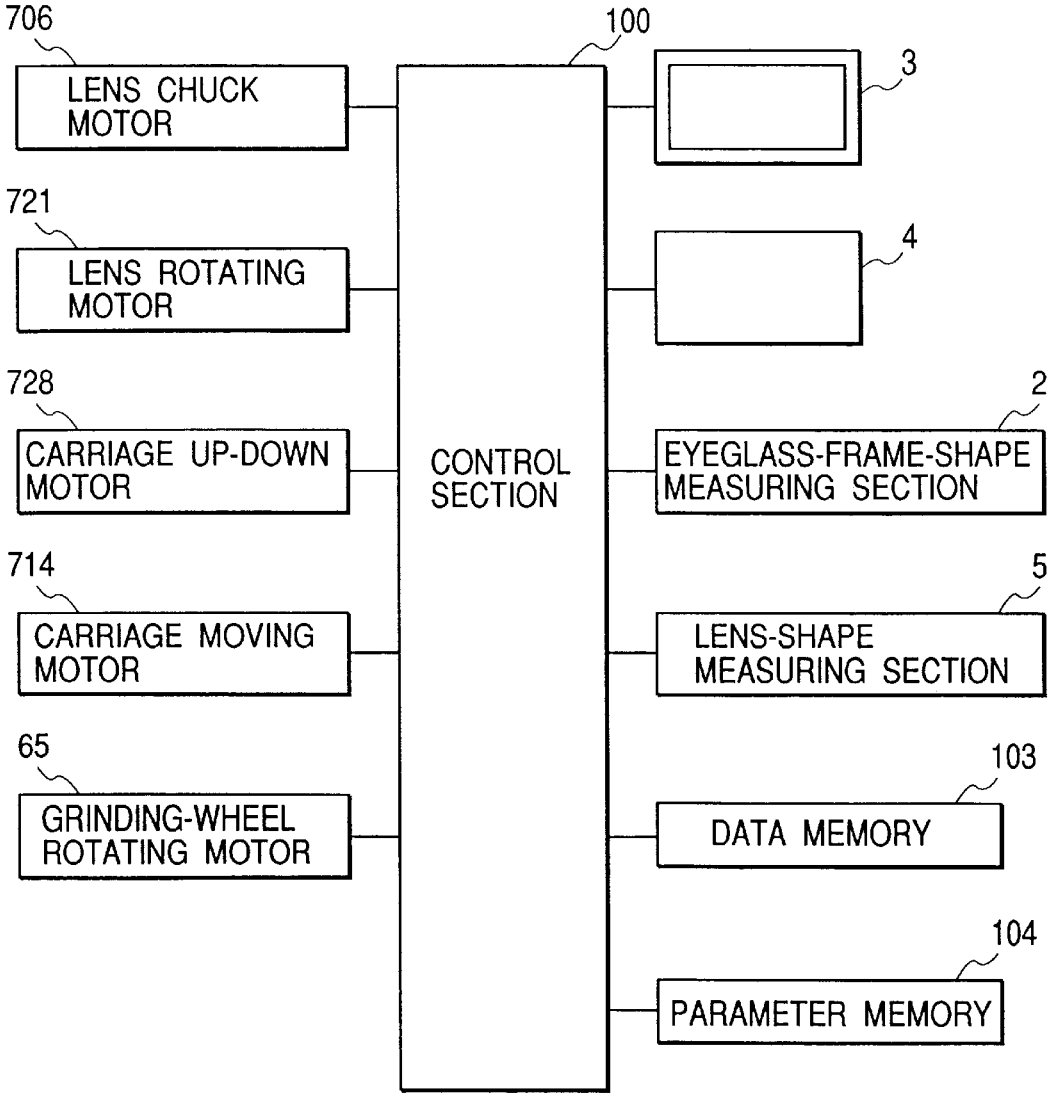
FIG. 2 is a block diagram of an overall control system of the processing apparatus.

Hereafter, a description will be given of an embodiment of the present invention with reference to the drawings. FIG. 1 is a perspective view illustrating an overall configuration of an eyeglass lens processing apparatus in accordance with the present invention, and FIG. 2 is a block diagram of an overall control system of the processing apparatus.

In FIG. 1 reference numeral 1 denotes a base on which various portions which make up this processing apparatus are mounted. Numeral 2 denotes an eyeglass-frame-shape measuring section which obtains a frame shape by moving a measurement probe, such as a feeler, kept in abutment with a frame groove of the eyeglass frame and by detecting the movement of the measurement probe. As the eyeglass-frame-shape measuring section 2, it is possible to use the one disclosed in U.S. Pat. No. 5,138,770. A display section 3 and an input section 4 which constitute the layout device are arranged in front of the frame measuring section 2. The display section 3 includes a liquid-crystal display on which a layout screen, a screen for setting parameters, a simulation screen concerning processing, and the like are displayed under control by a control section 100. The input section 4 has various switches for layout including switches for instructing the lens type (the monofocal lens, the bifocal lens, and the progressive multifocal lens) as well as switches for instructing processing (see FIG. 3). A lens-shape measuring section 5 for measuring the shape of a subject lens LE is provided on a front portion of the apparatus.

Numeral 6 denotes a grinding section in which a group of grinding wheels 60 having a rough grinding wheel and a bevel-finishing grinding wheel is rotatably mounted on a spindle unit 61 fixed to the base 1. The group of grinding wheels 60 is rotated by a motor 65 for rotating grinding wheels.

Numeral 7 denotes a carriage section, and numeral 700 denotes a carriage. Two lens rotating shafts 704*a* and 704*b* are coaxially and rotatably supported on the carriage 700. The lens rotating shaft 704*b* is axially movable by a lens chuck motor 706 provided on the carriage 700, and the lens LE is clamped between the shafts 704*a* and 704*b* through the opening/closing operation the lens rotating shaft 704*b*. In addition, the two lens rotating shafts 704*a* and 704*b* are rotated synchronously by a lens rotating motor 721.

The carriage 700 is rotatable and slidable on a shaft 701 fixed to the base 1, and constantly urged by a spring 731 so as to rotate toward the group of grinding wheels 60. The axis-to-axis distance between the lens rotating shaft and the group of grinding wheels 60 is adjusted by the rotation of a carriage up-down motor 728 attached to an intermediate plate 710. In addition, a rack 713 is fixed to the intermediate plate 710, and as a carriage-moving motor 714 having on its rotating shaft a pinion which meshes with the rack 713 rotates, the carriage 700 is moved in the axial direction of the shaft 701.

By virtue of such a configuration of the carriage section 7, the lens LE is brought into pressure contact with the group of grinding wheels 60 which rotates at high speed, and processing is effected. It should be noted that the configuration of this carriage section is similar to that disclosed in U.S. Pat. No. 5,347,762, and therefore reference should be had thereto for details.

Figure 3:
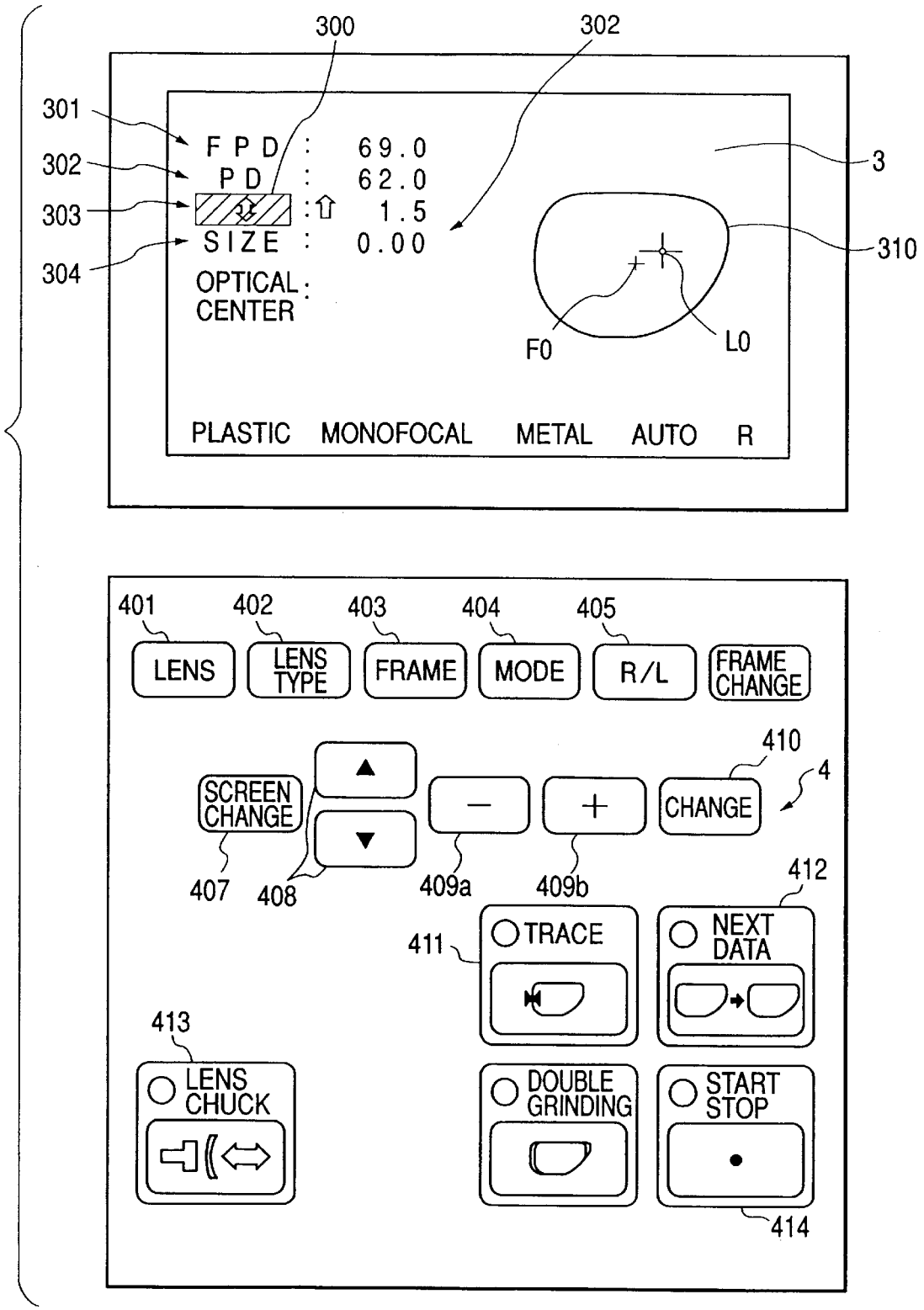
FIG. 3 is a diagram illustrating an external view of a display section and an input section.

In the apparatus having the above-described configuration, a description will be mainly given of the operation of layout by referring to FIG. 3 illustrating an external view of the display section 3 and the input section 4.

First, an eyeglass frame into which an eyeglass lens is to be fitted is set in the frame measuring section 2, and a trace switch 411 is pressed to instruct tracing. If a next-data switch 412 is pressed, the measured data obtained by the frame measuring section 2 are transferred to a processing apparatus side where they are stored in a data memory 103. Concurrently, a target lens configuration 310 based on the measured data on the eyeglass frame is displayed on the screen of the display section 3, and the apparatus is set in a state permitting the input of layout data and processing conditions.

The operator selects and inputs the material (glass, plastics, etc.) of the lens to be processed by operating a switch 401 and the type of lens (the monofocal lens, the bifocal lens, and the progressive multifocal lens) by operating a switch 402. In addition, the operator inputs the material of the eyeglass frame by operating a switch 403 and a processing mode (automatic processing of a bevel, forced processing, and plain-processing) by operating a switch 404. In the designation of the lens type and the like, displayed names in a lower row on the screen are changed over each time the switches are pressed, so that selected ones can be confirmed.

Subsequently, while viewing the layout screen of the display section 3, the operator selects an item 301 for inputting the distance between centers of eyeglass frame portions (FPD), and item 302 for inputting the wearer's pupillary distance (PD), and an item 303 for inputting the vertical (heightwise) layout, and inputs respective values. The selection of each item is made by moving a cursor 300 by operating two cursor-moving switches 408, and a prescription numeral of each selected item is inputted by operating a "–" switch 409*a* and a "+" switch 409*b*. Horizontal layout can be effected by inputting prescription values for the FPD item 301 and the PD item 302.

Here, as for the item 303, a layout method corresponding to the designation of the lens type made by the switch 402 is automatically set. Vertical layout methods corresponding to the lens types are stored in a parameter memory 104, and the control section 100 retrieves the layout method corresponding to the designated lens type from the parameter memory 104, and sets the retrieved layout method. For example, if the monofocal lens is designated, an optical center mode (mode for inputting the height of the optical center of the lens) is indicated in a display part 304, and the vertical layout method for the item 303 is set to the "frame center vertical" method by which the layout is carried out based on the height from the frame center (geometric center) F0 of the eyeglass frame to the optical center L0 of the lens (refer to the example of the screen in FIG. 3, and see FIG. 5).

Figure 4:
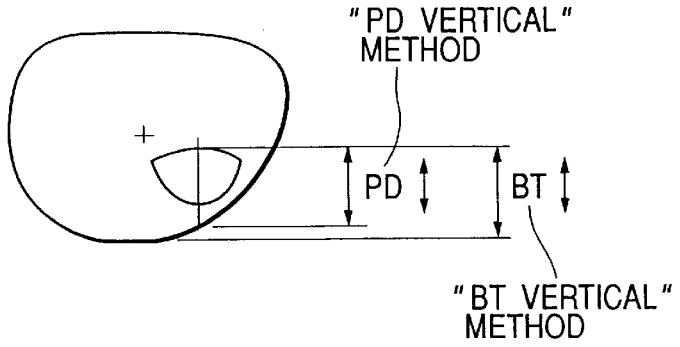
FIG. 4 is a diagram illustrating a vertical layout method in a bifocal lens.

If the bifocal lens is designated, the indication of the display part 304 is changed over to the bifocal mode, and the vertical layout method for the item 303 is set to the "BT vertical" method by which the layout is carried out based on the distance from the center of a small-lens upper boundary line to a lowest portion of the lens (see FIG. 4).

Figure 5:
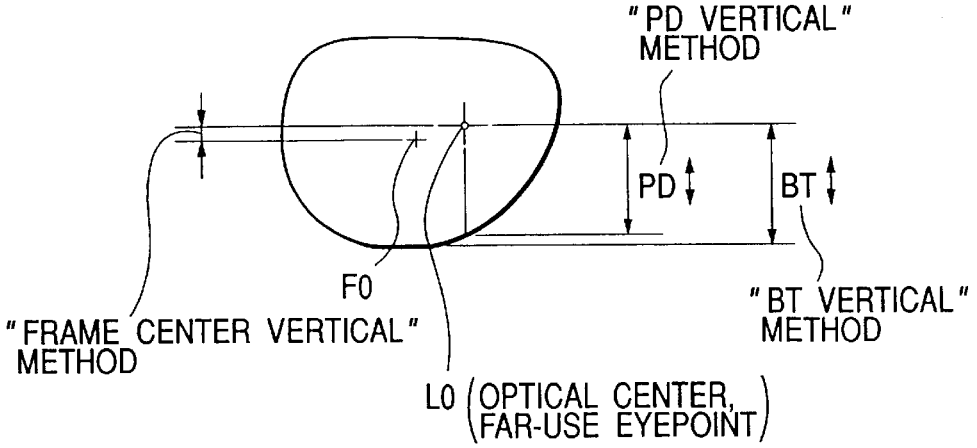
FIG. 5 a diagram illustrating a vertical layout method in a monofocal lens and a progressive multifocal lens.

If the progressive multifocal lens is designated, the indication of the display part 304 is changed over to the optical center mode, and the vertical layout method for the item 303 is set to the "PD vertical" method by which the layout is carried out based on the distance from the far-use eyepoint to the bottom of the lens directly therebelow (see FIG. 5).

Thus, with respect to the item 303 on the vertical layout, an appropriate one of methods which are preliminarily registered is set upon the designation of the lens type, and therefore the operator can easily input a prescription value without becoming confused in its selection. In addition, since it suffices if only prescription values are known, even a less-experienced operator can input the values without any error. In addition, the layout method which is automatically set can be changed to another method by moving the cursor 300 to the item 303 and operating a change switch 410 in the same way as with the related apparatus.

Figure 6:
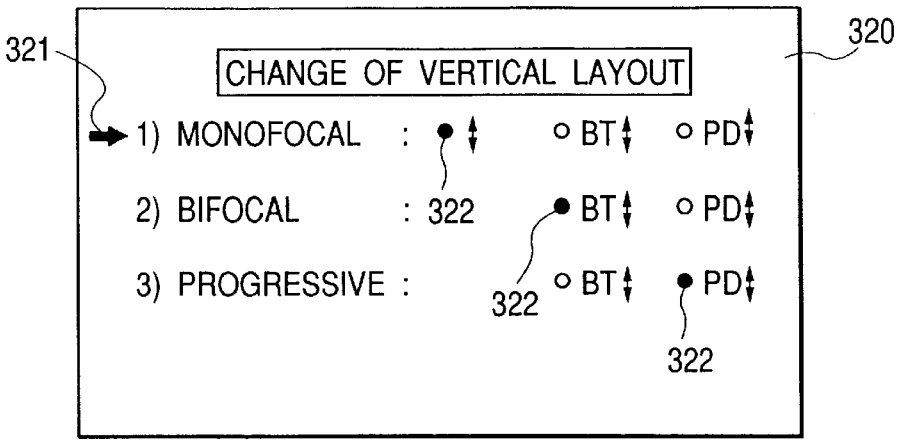
FIG. 6 is a diagram illustrating an example of a screen in a case where the relationship of the vertical layout method corresponding to lens type is changed.

The relationship between the lens types and the vertical layout methods which is stored in the parameter memory 104 can be changed by parameter setting. This change is made as follows. First, a screen-changing switch 407 is operated to retrieve and display the menu screen on the display section 3, and then an item for changing the vertical layout method is selected on the menu screen, so that a screen 320 for change is displayed as shown in FIG. 6. The move switch 408 is operated to move a display arrow 321 on this screen 320 to thereby select an item of the name of the lens type which is to be changed, and then the layout method on the right-hand side is changed by the switch 409*b* (or switch 409*a*). A filled circle 322 indicates the present layout method, and laterally moves each time the switch 409*b* is pressed. In the case of the monofocal lens, a change is possible from the "frame center vertical" method to the "PD vertical" method and the "BT vertical" method which are under the optical center mode and which use the lens bottom as a reference (see FIG. 5). In the case of the bifocal lens and the progressive multifocal lens, a change is possible to either the "PD vertical" method and the "BT vertical" method (see FIGS. 4 and 5). These may be preliminarily determined in accordance with the policy of an eyeglass shop. After the change is made, the screen-changing switch 407 is pressed so that the screen returns to the initial screen, and the corresponding relationship stored in the parameter memory 104 is rewritten.

After the input of the processing conditions and the input of the layout data, the lens LE with a suction cup aligned and attached thereto is chucked by the lens rotating shafts 704*a* and 704*b,* and then a switch 414 is pressed to start processing. In response to the input of the start signal, the control section 100 measures the lens shape by operating the lens measuring section 5, thereby obtaining processing data. If the automatic processing mode has been selected, rough processing and bevel finishing are subsequently effected continuously. On the basis of the processing data, the control section 100 controls the driving of each motor in the carriage section 7, causes the lens LE to be brought into pressure contact with the group of grinding wheels 60 which are rotating, thereby consecutively performing rough processing and finish processing.

Figure 7:
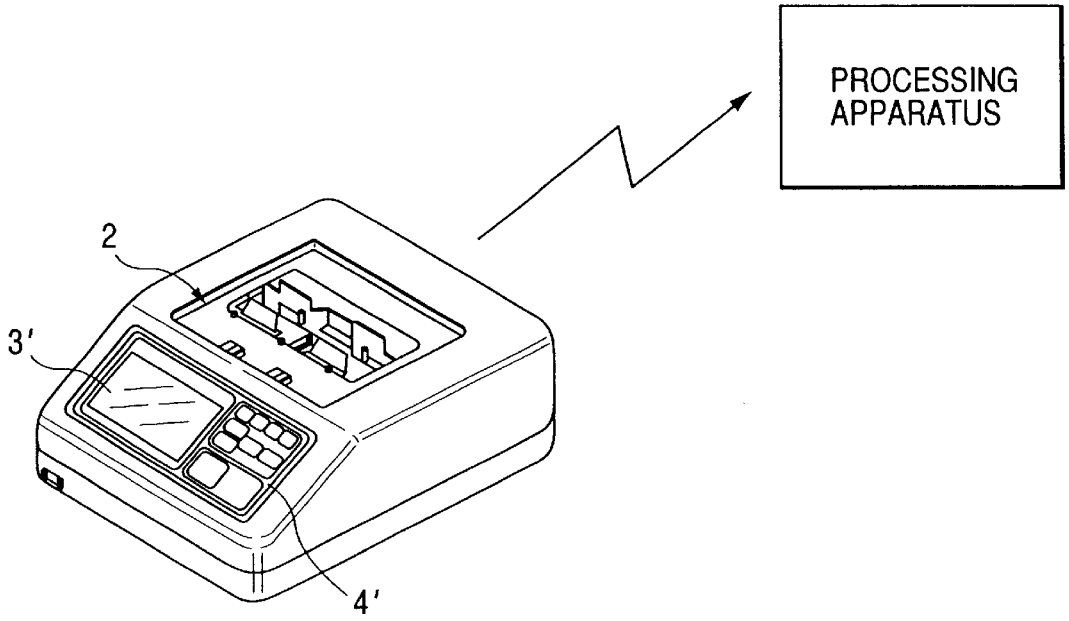
FIG. 7 is a diagram illustrating an example in which the present invention is embodied as a layout device of a type having a layout mechanism and an eyeglass-frame-shape measuring section.
Figure 8:
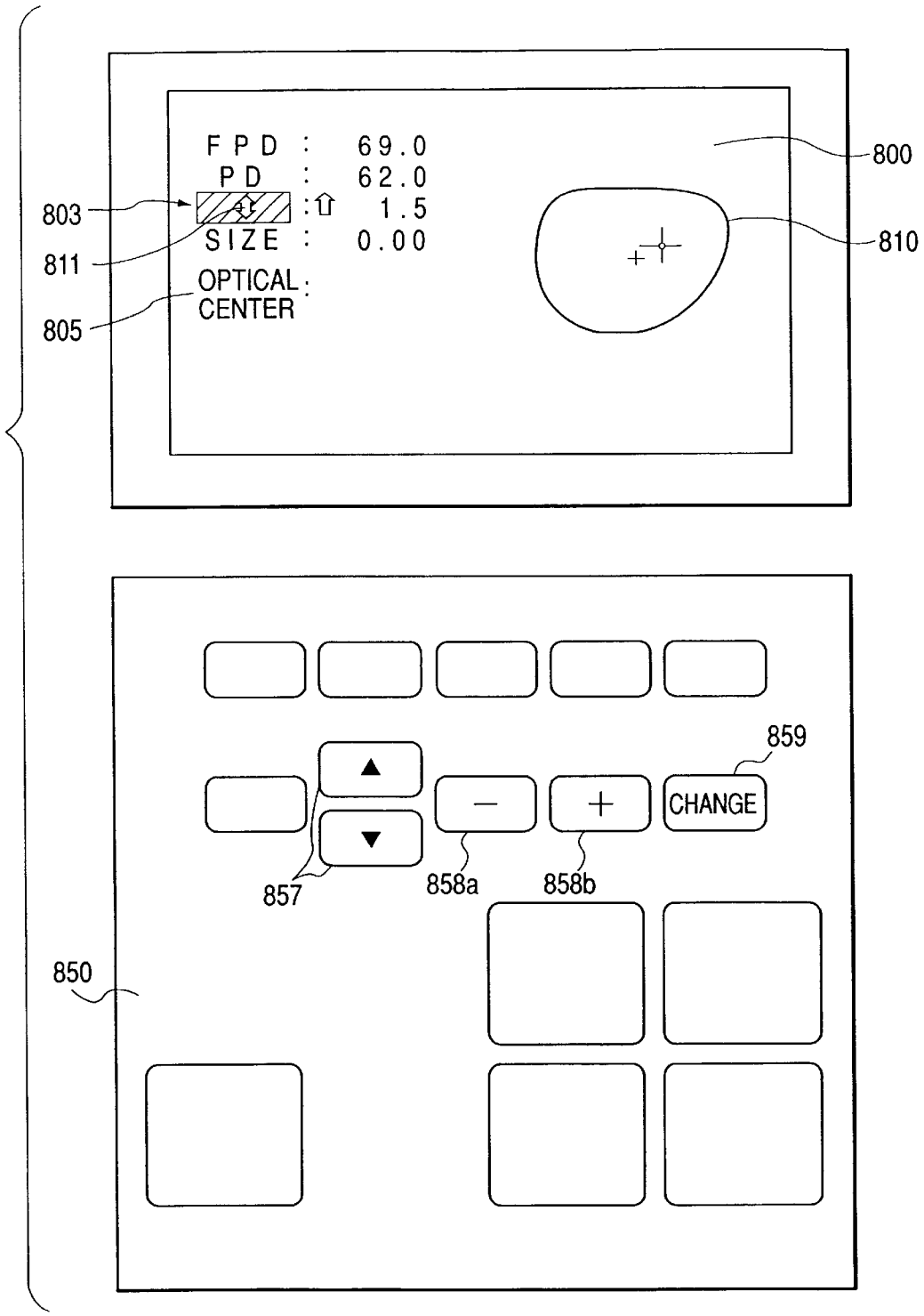
FIG. 8 is a diagram illustrating a display screen for layout and switches for input in a related apparatus.

Although a description has been given above of the eyeglass lens processing apparatus in which the layout mechanism and the frame measuring section 2 are installed integrally, the invention may be embodied as a layout device of the type having the layout mechanism and the frame measuring section 2, as shown in FIG. 7, or may be of a type in which the layout mechanism and the frame measuring section 2 are arranged separately. In the case of the layout device of the type shown in FIG. 7, after the frame shape data measured by the frame measuring section 2 are inputted by a transfer switch provided in an input section 4', layout data are inputted while viewing the screen of a display section 3' in the same way as in the above-described embodiment. The input section 4' has a switch for designating the lens type, and a layout system is automatically read and set in accordance with the designation of the lens type. The layout data obtained by this layout device can be transferred to and used by a processing apparatus in a remote place by connecting an external modem to the apparatus and through a telephone line.

As described above, in accordance with the present invention, since the operation for selecting a layout method in accordance with the lens type is not required, even a less-experienced operator is able to effect input without an error without becoming confused in selecting the layout method.

What is claimed is:

1. An eyeglass lens layout device for performing layout of an eyeglass lens with respect to a target lens shape, said device comprising:

a display portion;

a memory which stores at least two of: 1) data of a layout screen for inputting lateral and vertical layout data with respect to a target lens shape of a monofocal lens, 2) data of a layout screen for inputting lateral and vertical layout data with respect to a target lens shape of a multifocal lens including a bifocal lens, and 3) data of a layout screen for inputting lateral and vertical layout data with respect to a target lens shape of a progressive focal lens; each of the stored data including layout assisting graphic data that is suitable for the respective lens type and that includes target lens shape graphic data;

input means for inputting the lens type;

a control portion which, on the basis of an input signal of the input means, reads the data of the layout screen corresponding to the inputted lens type, and displays the layout screen corresponding to the inputted lens type on the display portion; and a data input unit which inputs layout data in accordance with the layout screen on the display portion.

2. An eyeglass lens layout device according to claim 1, wherein:

the data of the layout screen with respect to the monofocal lens includes at least one of: 1) screen data for layout of a distance between a geometric center of the target lens shape and an optical center of the lens, 2) screen data for layout of a distance from the optical center to a bottom of the target lens shape, which is located vertically below the optical center, and 3) screen data for layout of a distance from the optical center to a lowest point of the target lens shape;

the data of the layout screen with respect to the bifocal lens includes at least one of: 1) screen data for layout of a distance from a center of a small-lens upper boundary line to a bottom of the target lens shape, which is located vertically below the center of the small-lens upper boundary line, and 2) screen data for layout of a distance from the center of the small-lens upper boundary line to a lowest point of the target lens shape; and the data of the layout screen with respect to the progressive focal lens includes at least one of: 1) screen data for layout of a distance from a far-use eyepoint to a bottom of the target lens shape, which is located vertically below the far-use eyepoint, and 2) screen data for layout of a distance from the far-use eyepoint to a lowest point of the target lens shape.

3. An eyeglass lens layout device according to claim 1, wherein:

the memory stores plural screen data for at least one of the data of the layout screens with respect to respective lens types, and the device further comprising:

changing means for changing one of the plural screen data screen to another one of the plural screen data screen to be read by the control portion based on the inputted signal of the input means.

4. An eyeglass lens layout device according to claim 1, further comprising:

target lens shape data inputting means for inputting the target lens shape data, and wherein the control portion obtains lens processing data based on the inputted target lens shape data and the layout data.

5. An eyeglass lens layout device according to claim 1, further comprising:

target lens shape data inputting means for inputting the target lens shape data; and transmitting means for data transmission to an eyeglass lens processing apparatus for grinding a periphery of the lens.

6. An eyeglass lens layout device according to claim 1, wherein the eyeglass lens layout device is installed in an eyeglass lens processing apparatus for grinding a periphery of the lens.

7. An eyeglass lens layout device according to claim 1, wherein the input means includes a lens type input key which is made operable when at least one of lens material and frame material is inputted.

8. An eyeglass lens layout device for performing layout of an eyeglass lens with respect to a target lens shape, said device comprising:

a display portion;

a memory which stores at least two of: 1) data of a layout screen for inputting vertical layout data with respect to a target lens shape of a monofocal lens, 2) data of a layout screen for inputting vertical layout data with respect to a target lens shape of a multifocal lens including a bifocal lens, and 3) data of a layout screen for inputting vertical layout data with respect to a target lens shape of a progressive focal lens; each of the stored data including layout assisting graphic data that is suitable for the respective lens type and that includes target lens shape graphic data;

input means for inputting the lens type;

a control portion which, on the basis of an input signal of the input means, reads the data of the layout screen corresponding to the inputted lens type, and displays the layout screen corresponding to the inputted lens type on the display portion; and a data input unit which inputs layout data in accordance with the layout screen on the display portion.

* * * * *